US009360804B2

(12) United States Patent
Lee et al.

(10) Patent No.: US 9,360,804 B2
(45) Date of Patent: Jun. 7, 2016

(54) IMAGE FORMING APPARATUS AND CONTROL METHOD THEREOF

(71) Applicant: Samsung Electronics Co., Ltd., Suwon-si (KR)

(72) Inventors: Young Bok Lee, Seoul (KR); Hyoung Il Kim, Hwaseong-si (KR); Young Jung Yun, Suwon-si (KR); Jin Soo Lee, Yongin-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/678,483

(22) Filed: Apr. 3, 2015

(65) Prior Publication Data

US 2015/0362865 A1 Dec. 17, 2015

(30) Foreign Application Priority Data

Jun. 11, 2014 (KR) ..... 10-2014-0070531

(51) Int. Cl.
*G03G 15/00* (2006.01)
*G03G 21/00* (2006.01)
*G03G 15/14* (2006.01)

(52) U.S. Cl.
CPC ..... *G03G 15/14* (2013.01)

(58) Field of Classification Search
CPC ..... G03G 15/00; G03G 15/14; G03G 21/00; G03G 21/14; B41J 11/42; B41J 13/00; B65H 7/14
See application file for complete search history.

(56) References Cited

U.S. PATENT DOCUMENTS 6,374,075 B1 * 4/2002 Benedict ..... B65H 9/002 399/394
6,374,076 B1 * 4/2002 Tanaka ..... G03G 15/0194 399/396
8,755,700 B2 * 6/2014 Takano ..... G06K 15/16 399/301
2003/0108372 A1 * 6/2003 Takeda ..... B65H 7/14 399/394
2006/0056894 A1 * 3/2006 Kawashima ..... G03G 15/6564 399/384
2006/0177253 A1 * 8/2006 Aiko ..... G03G 15/6567 399/394
2008/0193180 A1 * 8/2008 Shim ..... B41J 11/003 399/395
2010/0329760 A1 * 12/2010 Nishida ..... G01P 3/489 399/396
2011/0158724 A1 * 6/2011 Fujita ..... G03G 15/6567 399/395
2011/0211896 A1 * 9/2011 Kawaguchi ..... B41J 11/008 400/582
2011/0242553 A1 * 10/2011 Yamazaki ..... B41J 11/42 358/1.5
2012/0141179 A1 * 6/2012 Atsumi ..... G03G 15/6567 399/381
2014/0044460 A1 * 2/2014 Kudo ..... G03G 15/5054 399/301

FOREIGN PATENT DOCUMENTS

JP 09208075 A * 8/1997 ..... G03G 21/00
JP 2006001679 A * 1/2006 ..... G03G 15/00
JP 2007-296647 11/2007
JP 2012078545 A * 4/2012 ..... G03G 15/14
JP 2012-220405 11/2012

* cited by examiner

*Primary Examiner* — Nguyen Ha
(74) *Attorney, Agent, or Firm* — Staas & Halsey LLP

(57) ABSTRACT

An image forming apparatus to control a distance between paper sheets by sensing a surface pattern of fed paper and a method of controlling the same is provided. The image forming apparatus may include a paper transport unit configured to transport paper, a paper sensing unit disposed in a transport path of the paper and configured to sense a surface pattern of the transported paper, and a controller configured to control the paper transport unit to adjust a distance between paper sheets based on a change in the sensed surface pattern of the paper.

18 Claims, 19 Drawing Sheets

IMAGE FORMING APPARATUS AND CONTROL METHOD THEREOF

CROSS-REFERENCE TO RELATED APPLICATIONS

This application claims the priority benefit of Korean Patent Application No. 10-2014-0070531, filed on Jun. 11, 2014 in the Korean Intellectual Property Office, the disclosure of which is incorporated herein by reference.

BACKGROUND

1. Field

Embodiments of the present disclosure relate to an image forming apparatus that forms an image on a print medium and a method of controlling the same.

2. Description of the Related Art

An image forming apparatus is an apparatus capable of printing an image on a print medium such as printing paper. Examples of the image forming apparatus include printers, photocopiers, facsimiles, and multifunction printers having some or all of the functions of these devices.

Image forming apparatuses are classified into inkjet-type image forming apparatuses that print an image onto a print medium by jetting and ejecting fine ink droplets onto a desired region of the print medium and electrophotographic image forming apparatuses that print an image by supplying toner to a latent image formed by scanning light beams onto a photosensitive drum and transferring the latent image onto a print medium.

An image forming apparatus may form an image by receiving paper stacked in a paper cassette and transporting the received paper. In this regard, since printing speed and quality may be determined in accordance with a distance between paper sheets, the image forming apparatus may include a unit of controlling the distance between the paper sheets.

SUMMARY

Therefore, it is an aspect of the present disclosure to provide an image forming apparatus controlling a distance between paper sheets by sensing surface patterns of the paper sheets fed to the image forming apparatus and a method of controlling the same.

In accordance with an aspect of the present disclosure, an image forming apparatus includes a paper transport unit configured to transport paper, a paper sensing unit disposed in a transport path of the paper and configured to sense a surface pattern of the transported paper, and a controller configured to control the paper transport unit to adjust a distance between paper sheets based on a change in the sensed surface pattern of the paper.

The controller may acquire a transport speed of the paper by using the change in the surface pattern of the paper and control the paper transport unit to maintain a predetermined paper sheet interval by using the acquired transport speed of the paper.

The controller may acquire a degree of skew of the paper by using the change in the surface pattern of the paper and control the paper transport unit to correct the skew of the paper for a period of time corresponding to the acquired degree of skew of the paper.

The paper transport unit may include feed rollers configured to transfer a transport force to the paper, and registration rollers configured to block proceeding of the paper to which the transport force is transferred by the feed rollers, and the paper sensing unit may be disposed in the transport path of the paper between the feed rollers and the registration rollers.

The paper sensing unit may include a first image sensor disposed closer to the registration rollers than the feed rollers to sense a surface pattern of a paper transported before following paper.

The controller may acquire a transport speed of the paper by using a change in the surface pattern of the paper sensed by the first image sensor and control the registration rollers to block proceeding of the following paper at a time point corresponding to the transport speed of the paper.

The image forming apparatus may further include a paper feed unit configured to sequentially feed the paper and the following paper to the paper transport unit, and the controller may acquire a transport speed of the paper by using a change in the surface pattern of the paper sensed by the first image sensor and control the paper feed unit to feed the following paper at a time point corresponding to the transport speed of the paper.

The paper sensing unit may include a second image sensor disposed closer to the feed rollers than the registration rollers to sense a surface pattern of the following paper transported after the paper.

The controller may acquire a transport speed of the following paper by using a change in the surface pattern of the following paper sensed by the second image sensor and control the feed rollers to transfer a transport force corresponding to the transport speed to the following paper.

The controller may acquire a degree of skew of the following paper by using a change in the surface pattern of the following paper sensed by the second image sensor and control the registration rollers to block proceeding of the following paper for a period of time corresponding to the degree of skew.

The image forming apparatus may further include an image forming unit configured to transfer an image to the paper by using a photosensitive drum on which toner is coated, and the controller may control the image forming unit to coat the toner on the photosensitive drum at a time point corresponding to when the registration rollers resume the proceeding of the paper.

In accordance with an aspect of the present disclosure, a method of controlling an image forming apparatus sequentially transporting a plurality sheets of paper includes sensing a surface pattern of the transported paper, and controlling a distance between the paper sheets based on a change in the sensed surface pattern.

The controlling of the distance between the paper sheets may include acquiring a transport speed of the paper by using a change in the surface pattern of the paper, and transporting the paper while maintaining a predetermined distance between the paper sheets by using the acquired transport speed.

The acquiring of the transport speed of the paper may include acquiring a transport speed of paper by using a change in a surface pattern of the paper transported before following paper.

The transporting of the paper while maintaining the predetermined distance between the paper sheets may include blocking proceeding of the following paper at a time point corresponding to the transport speed of the paper.

The transporting of the paper while maintaining the predetermined distance between the paper sheets may include feeding the following paper to a paper transport unit of the image forming apparatus at a time point corresponding to the transport speed of the paper.

The acquiring of the transport speed of the paper may include acquiring a transport speed of the following paper by using a change in a surface pattern of the following paper transported after the paper.

The transporting of the paper while maintaining the predetermined distance between the paper sheets may include transferring a transport force corresponding to the transport speed of the following paper to the following paper.

The method may further include acquiring a degree of skew of the paper by using the change in the surface pattern of the paper, and correcting the skew of the paper for a period of time corresponding to the acquired degree of skew.

The acquiring of the degree of skew of the paper may include acquiring a degree of skew of the paper when a front edge of the paper reaches registration rollers of the image forming apparatus.

The correcting of the skew of the paper may include blocking proceeding of the paper for a period of time corresponding to the degree of skew.

The method may further include coating toner on a photosensitive drum of the image forming apparatus at a time point corresponding to when the blocked proceeding of the paper is resumed.

In accordance with an aspect of the present disclosure, an image forming apparatus includes a paper transport unit configured to transport paper, and a controller configured to control the paper transport unit to adjust a distance between paper sheets based on a transport speed of the paper.

The paper transport unit may include feed rollers configured to transfer a transport force to the paper, and registration rollers configured to block proceeding of the paper to which the transport force is transferred by the feed rollers, and the controller may acquire a transport speed of paper transported before following paper.

The controller may control the registration rollers to block proceeding of the following paper at a time point corresponding to the transport speed of the paper.

The image forming apparatus may include a paper feed unit configured to sequentially feed the paper and the following paper to the paper transport unit, and the controller may control the paper feed unit to feed the following paper at a time point corresponding to the transport speed of the paper.

The paper transport unit may include feed rollers configured to transfer a transport force to the paper, and registration rollers configured to block proceeding of the paper to which the transport force is transferred by the feed rollers, and the controller may acquire a transport speed of the following paper transported after the paper.

The controller may control the feed rollers to transfer a transport force corresponding to the transport speed of the following paper to the following paper.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1A:
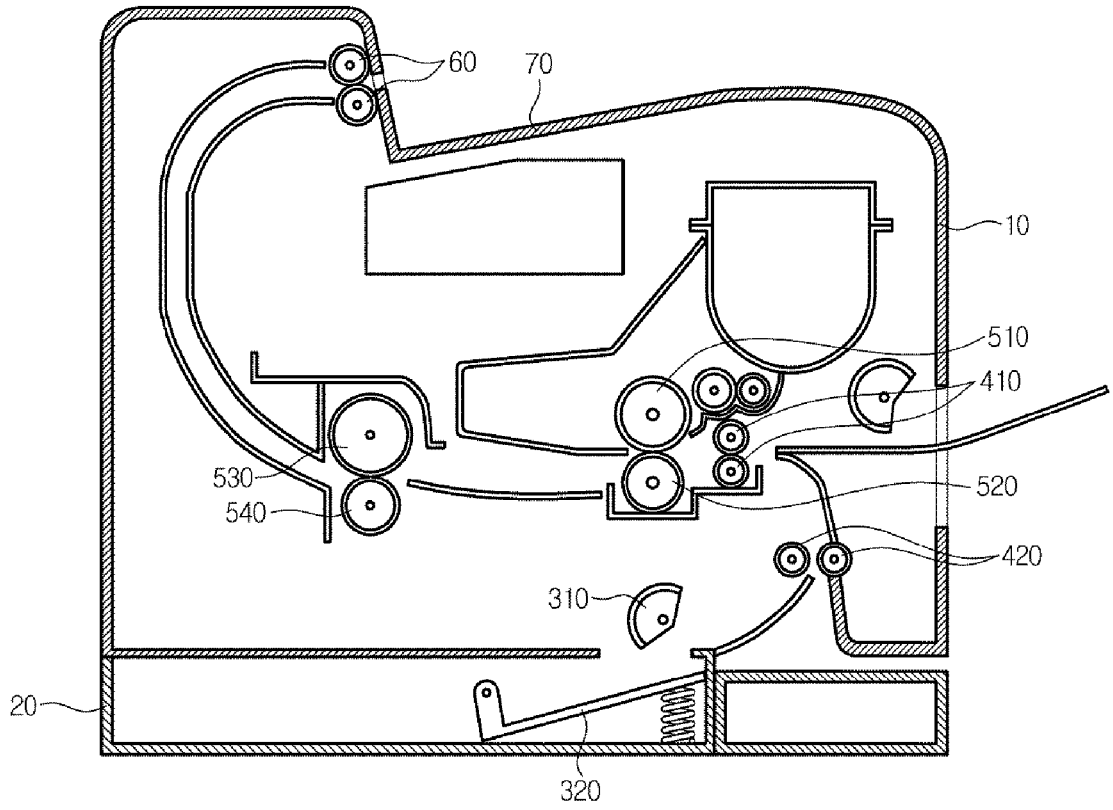
FIGS. 1A and 1B are schematic cross-sectional views illustrating image forming apparatuses according to an embodiment of the present disclosure.

Reference will now be made in detail to embodiments of the present disclosure, examples of which are illustrated in the accompanying drawings, wherein like reference numerals refer to like elements throughout.

An image forming apparatus and a method of controlling the same will be described in detail with reference to the drawings.

Figure 1B:
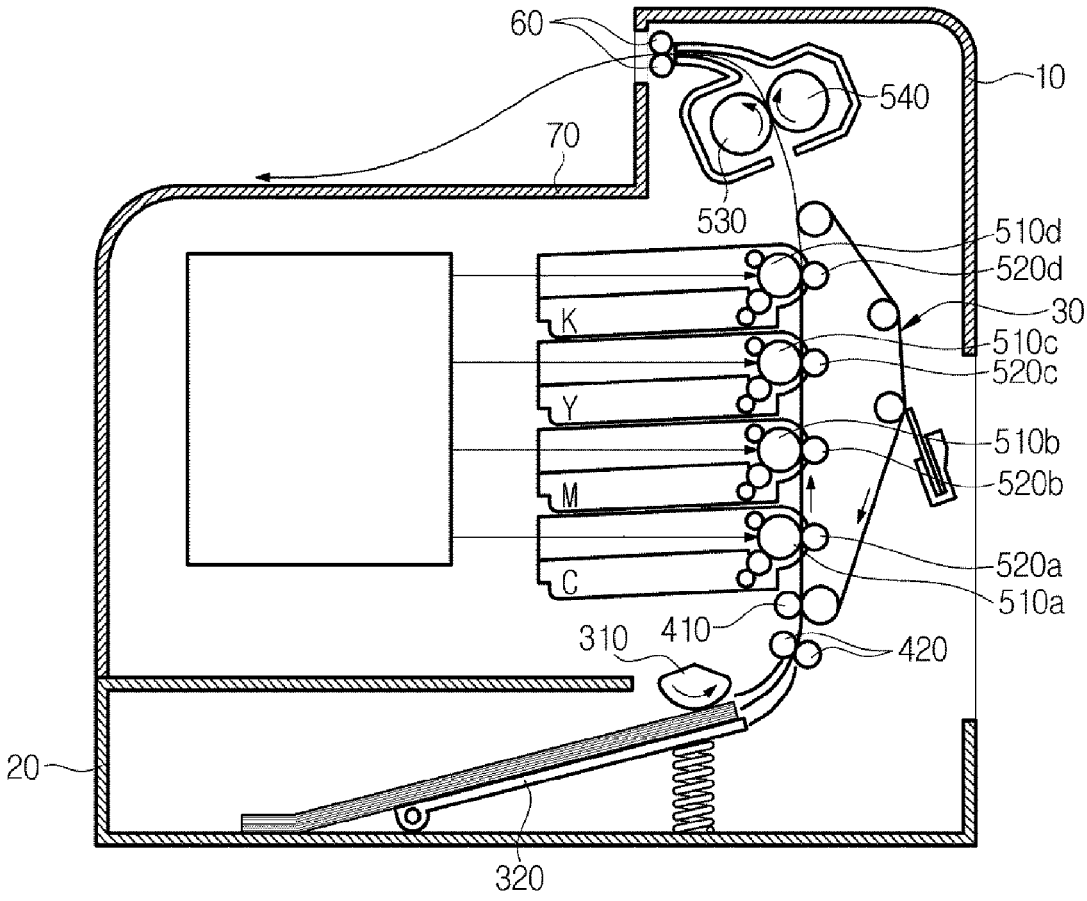

FIGS. 1A and 1B are schematic cross-sectional views of image forming apparatuses according to various embodiments of the present disclosure. FIG. 1A illustrates a monotype image forming apparatus and FIG. 1B illustrates a color-type image forming apparatus.

Referring to FIG. 1A, the image forming apparatus includes: a case 10 defining an external appearance; a paper cassette 20 configured to stack a plurality of sheets of paper for printing and disposed at a lower portion of the case 10; a paper feed unit 300 configured to feed the paper stacked in the paper cassette to a paper transport unit (paper transporter) 400; the paper transport unit 400 configured to transport the fed paper; an image forming unit 500 configured to form an image on the paper transported by the paper transport unit 400; a paper discharge roller 60 configured to discharge the paper on which the image is formed; and a paper discharge tray 70 in which the discharged paper is located.

The paper feed unit 300 may include a knock-up plate 320 to raise the paper stacked in the paper cassette upward and a pick-up roller 310 to feed paper supported by the knock-up plate to the paper transport unit 400.

The paper feed unit 300 may select one of the plurality of sheets of paper at a time by using the knock-up plate 320 and the pick-up roller 310. The paper feed unit 300 feeds the selected paper to the paper transport unit 400 to perform printing.

The paper transport unit 400 may include feed rollers 420 to transfer a transport force to the paper and registration rollers 410 to block proceeding of the paper to which the transport force is transferred by the feed rollers 420.

The feed rollers 420 may rotate in one direction by a driving force received from a motor. The feed rollers 420 may contact surfaces of the fed paper and transfer the transport force to the paper via friction formed at the contact surfaces.

The registration rollers 410 may also rotate in one direction by a driving force received from the motor. The registration rollers 410 may transport the paper while contacting the paper to which the transport force is transferred. Furthermore, the registration rollers 410 may block the proceeding of the paper by stopping rotation in accordance with a control by a controller. This will be described later.

The image forming unit 500 may form an image on the paper received from the paper transport unit 400. To this end, the image forming unit 500 may include a photosensitive drum 510, a transfer roller 520, a fusing roller 530, and a pressing roller 540.

A latent image may be formed on the surface of the photosensitive drum 510. In this regard, the latent image may be formed by processing print data received from a host such as a computer. After the latent image is formed, toner may be uniformly coated on the surface of the photosensitive drum 510. As a result, the image forming unit 500 is in a state capable of forming an image on the paper.

When the image forming unit 500 is ready for printing and the paper is transported from the paper transport unit 400, the photosensitive drum 510 and the transfer roller 520 may attach the toner to the surface of the paper. That is, the paper may pass between the photosensitive drum 510 and the transfer roller 520. As a result, toner may be attached to the surface of the paper in a shape of the image to be printed.

The fusing roller 530 and the pressing roller 540 may fuse the toner attached to the surface of the paper. The surface of the fusing roller 530 may be heated at a high temperature. The pressing roller 540 may be disposed under the fusing roller 530 and contact the fusing roller 530 while applying a strong pressure thereto. The paper to which the toner is attached may pass between the fusing roller 530 and the pressing roller 540. In this process, the toner attached to the paper may be exposed to a high-temperature and high-pressure environment. As a result, the toner is melted and fused to the surface of the paper, thereby forming an image.

The paper on which the image is formed by the fusing process may be discharged to the paper discharge tray 70 by the paper discharge roller 60.

Referring to FIG. 1B, the color type image forming apparatus may also include the same constituent elements as the mono-type image forming apparatus. Since constituent elements of the color-type image forming apparatus are the same as those of the mono-type image forming apparatus, detailed descriptions thereof will not be given herein.

In addition, the color-type image forming apparatus may include a plurality of photosensitive drums 510*a*, 510*b*, 510*c*, and 510*d* on which cyan, magenta, yellow, and black toners are respectively coated and a plurality of transfer rollers 520*a*, 520*b*, 520*c*, and 520*d* corresponding thereto. The color-type image forming apparatus may further include a transfer belt 30 to assist the paper to which the transport force is transferred by the feed rollers 420 to pass between the plurality of photosensitive drums 510*a*, 510*b*, 510*c*, and 510*d* and the plurality of transfer rollers 520*a*, 520*b*, 520*c*, and 520*d*.

When a plurality of sheets of paper are sequentially fed for printing, an interval between paper sheets is referred to as a paper sheet interval. As high-speed printing has come into widespread use, it is becoming increasingly important to control the paper sheet interval in accordance with a proceeding speed of paper. Thus, according to an embodiment, an image forming apparatus capable of sensing a pattern change of paper and controlling the paper sheet interval based on the pattern change may be provided.

Figure 2:
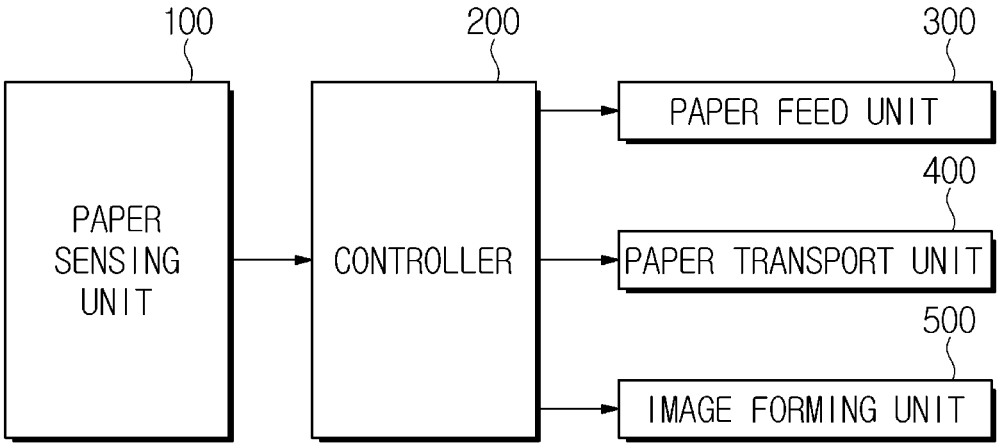
FIG. 2 is a control block diagram illustrating an image forming apparatus according to an embodiment of the present disclosure.

FIG. 2 is a control block diagram illustrating an image forming apparatus according to an embodiment of the present disclosure.

According to an embodiment, the image forming apparatus may further include: a paper transport unit 400 configured to transport paper; a paper sensing unit (paper sensor) 100 disposed in a paper transport path and configured to sense a surface pattern of the transported paper; and a controller 200 configured to control the paper transport unit 400 such that a distance between paper sheets based on a change in the sensed surface pattern change of the paper.

In addition, the image forming apparatus may further include: a paper feed unit 300 configured to sequentially feed the plurality of sheets of paper to the paper transport unit 400; and an image forming unit 500 configured to transfer an image to the paper by using a photosensitive drum 510 on which toner is coated.

The paper transport unit 400, the paper feed unit 300, and the image forming unit 500 are the same as those described above with reference to FIG. 1, and thus detailed descriptions thereof will not be given herein. However, a method of controlling the paper transport unit 400, the paper feed unit 300, and the image forming unit 500 will be described later with reference to the controller 200.

The paper sensing unit 100 may be disposed in the paper transport path and may sense the pattern of paper in real time. To this end, the paper sensing unit 100 may sense the pattern of paper formed in a predetermined region at regular time intervals. Since the paper proceeds along the paper transport path by the paper transport unit 400, the controller 200, which will be described later, may acquire a transport speed of the paper by using a pattern change of the paper sensed by the paper sensing unit 100 at regular time intervals. The acquired transport speed of the paper may be used to control the paper sheet interval.

The paper sensing unit 100 may be disposed in the paper transport path between the feed rollers 420 and the registration rollers 410 of the paper transport unit 400. Particularly, the paper sensing unit 100 may include: a first image sensor 110 disposed to be closer to the registration rollers 410 than the feed rollers 420 to sense a surface pattern of paper that is transported before following paper; and a second image sensor 120 disposed to be closer to the feed rollers 420 than the registration rollers 410 to sense a surface pattern of the following paper that is transported after the paper.

Figure 3:
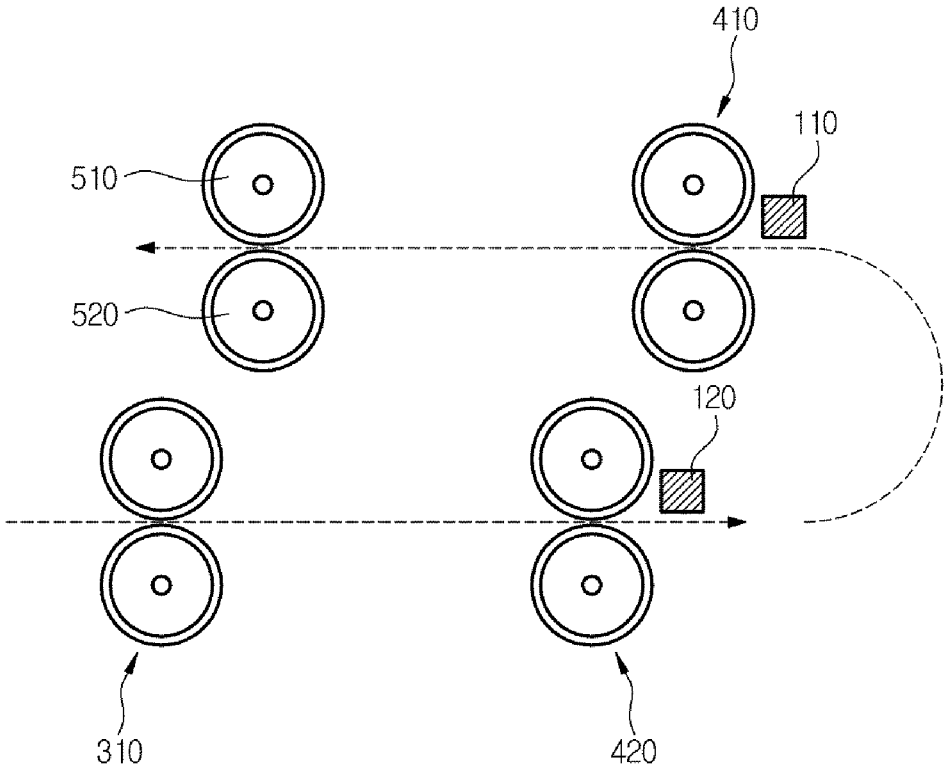
FIG. 3 is a diagram for describing a position of a paper sensing unit of an image forming apparatus according to an embodiment of the present disclosure.

FIG. 3 is a diagram for describing a position of a paper sensing unit 100 of an image forming apparatus according to an embodiment of the present disclosure. Dashed lines indicate a paper transport path, and arrows indicate a paper transport direction.

As described above, the paper fed by the pick-up roller 310 of the paper feed unit 300 may be transported along the paper transport path by the feed rollers 420 of the paper transport unit 400. The registration rollers 410 may control transporting of the paper proceeding along the paper transport path, and an image may be formed on the paper discharged from the registration rollers 410 while passing between the photosensitive drum 510 and the transfer roller 520.

The first image sensor 110 of the paper sensing unit 100 may be disposed adjacent to the registration rollers 410 to sense the surface pattern of the paper immediately before the paper passes between the registration rollers 410. Accordingly, the first image sensor 110 may sense the surface pattern of the paper when the paper passes between the registration rollers 410.

In addition, the second image sensor 120 of the paper sensing unit 100 may be disposed adjacent to the feed rollers 420 to sense the surface pattern of the paper immediately after the paper passes between the feed rollers 420. Accordingly, the second image sensor 120 may sense the surface pattern of the following paper when the paper passes between the feed rollers 420.

The first image sensor 110 and the second image sensor 120 of the paper sensing unit 100 may emit light to a predetermined region and receive reflected light in order to sense the surface pattern of the paper. Since light reflected by the surface of the paper includes information regarding the surface pattern of the paper, the paper sensing unit 100 may sense the surface pattern of the paper by receiving light reflected by the surface of the paper.

To this end, the first image sensor 110 and second image sensor 120 may respectively include a light emitting unit and a light receiving unit. The light emitting unit may be implemented using a light emitting diode (LED) and may emit light to the paper, and the light receiving unit may receive light reflected by the paper. The light receiving light may acquire information regarding the surface pattern of the paper based on the received light. The light receiving unit may be implemented using a complementary metal-oxide semiconductor (CMOS) or a charge-coupled device (CCD) and may also be implemented in various manners to sense a surface pattern of paper by receiving reflected light within the scope of the present disclosure.

Referring back to FIG. 2, the controller 200 may control the paper sheet interval by using the surface pattern of paper sensed by the paper sensing unit 100. Particularly, the controller 200 may acquire the transport speed by comparing surface patterns of paper acquired at regular time intervals and using the degree of change in the surface patterns.

Figure 4A:
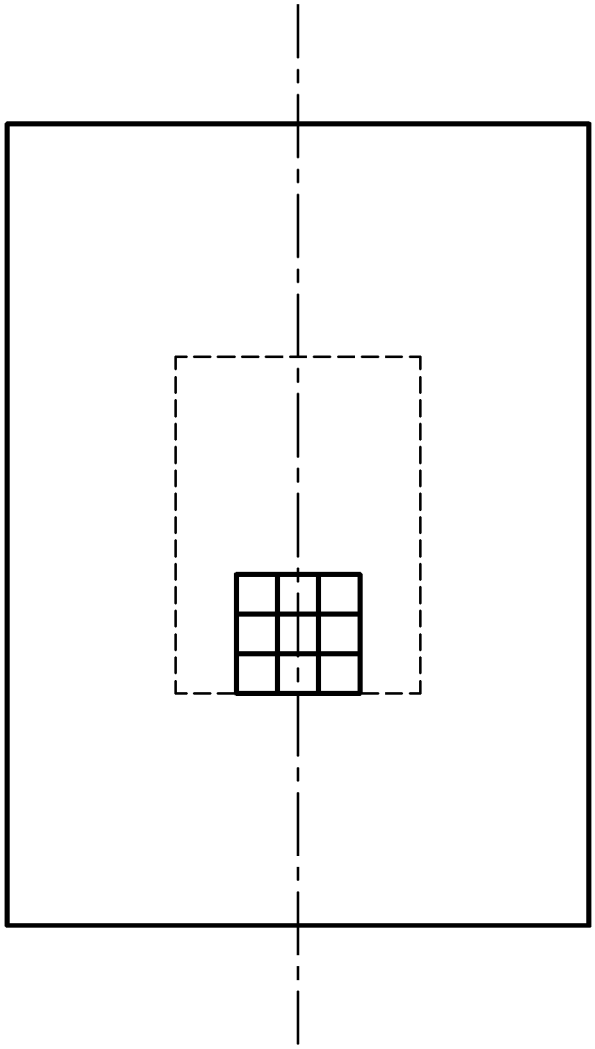
FIGS. 4A and 4B are diagrams for describing a method of acquiring a transport speed of paper by a controller of an image forming apparatus according to an embodiment of the present disclosure.
Figure 4B:
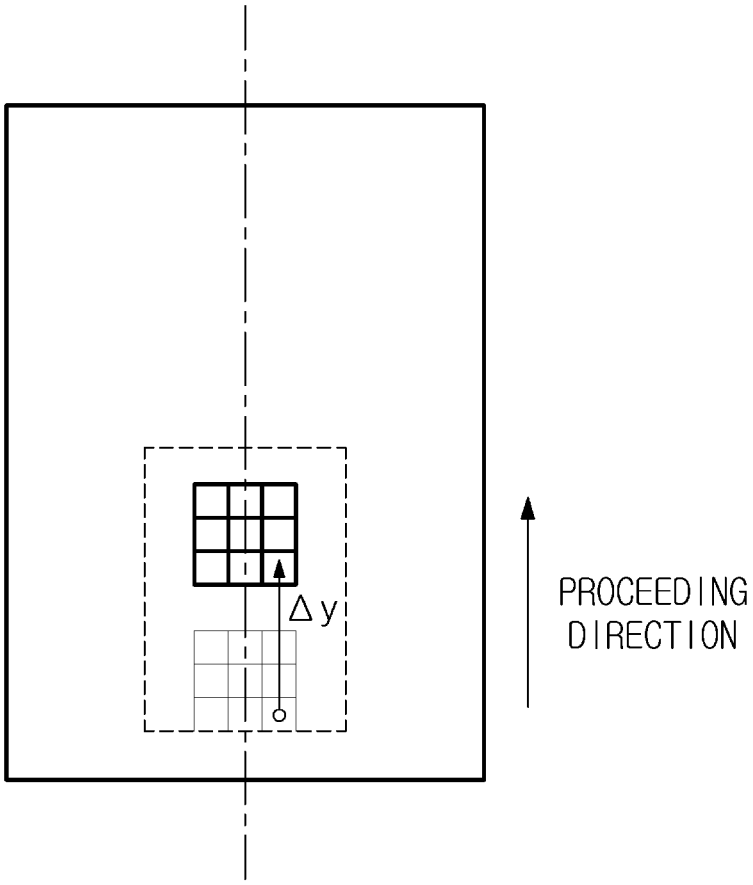

FIGS. 4A and 4B are diagrams for describing a method of acquiring a transport speed of paper by a controller of an image forming apparatus according to an embodiment of the present disclosure. Regions marked by dashed lines may be regions including surface patterns of the paper sensed by the paper sensing unit 100.

As described above, the paper sensing unit 100 may sense the surface patterns of paper at regular time intervals. For example, as illustrated in FIG. 4A, the paper sensing unit 100 may sense the surface pattern within the region marked by the dashed line. After one period T, the paper sensing unit 100 may sense the surface pattern in the dashed line as illustrated in FIG. 4B. Upon comparison between the sensed surface pattern of the paper of FIG. 4A with the sensed surface pattern of the paper of FIG. 4B, it may be confirmed that the paper is transported by Δy in the proceeding direction.

The controller 200 may acquire the transport speed of the paper based thereon. Particularly, the controller 200 may acquire the transport speed of the paper by using Equation 1.

$$V = \frac{\Delta y}{T} \qquad \text{Equation 1}$$

In Equation 1, V is a transport speed, T is a period in which the paper sensing unit 100 acquires the surface pattern of the paper, and Δy is a distance of paper transported during one period.

The controller 200 may control the paper transport unit 400 or the paper feed unit 300 such that a predetermined interval is maintained between paper sheets by using the acquired transport speed. In this regard, the predetermined interval may be an optimal paper sheet interval for high-speed printing and may be preset during a manufacturing process or may be predetermined by computation of a device. Alternatively, the interval may be predetermined by a desired paper sheet interval input by a user.

A method of controlling the paper sheet interval by the controller will be described with reference to FIGS. 5A, 5B, 6A, and 6B.

Figure 5A:
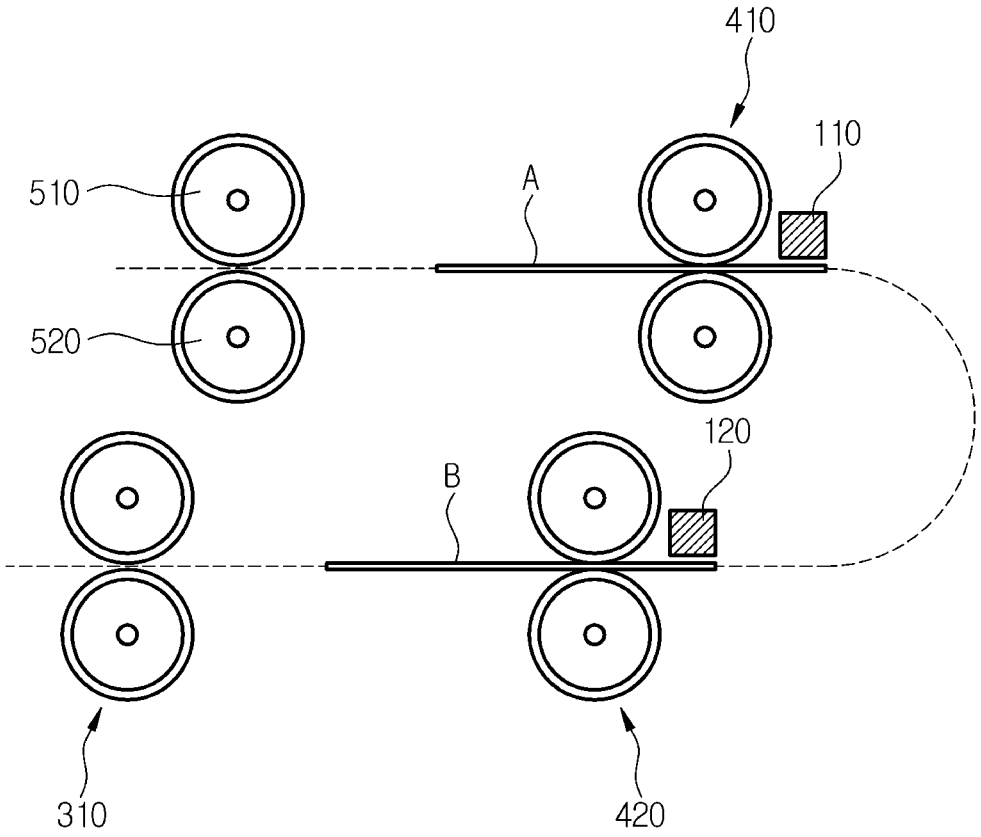
FIGS. 5A and 5B are diagrams for describing a method of controlling a paper sheet interval by a controller of an image forming apparatus according to an embodiment of the present disclosure.
Figure 5B:
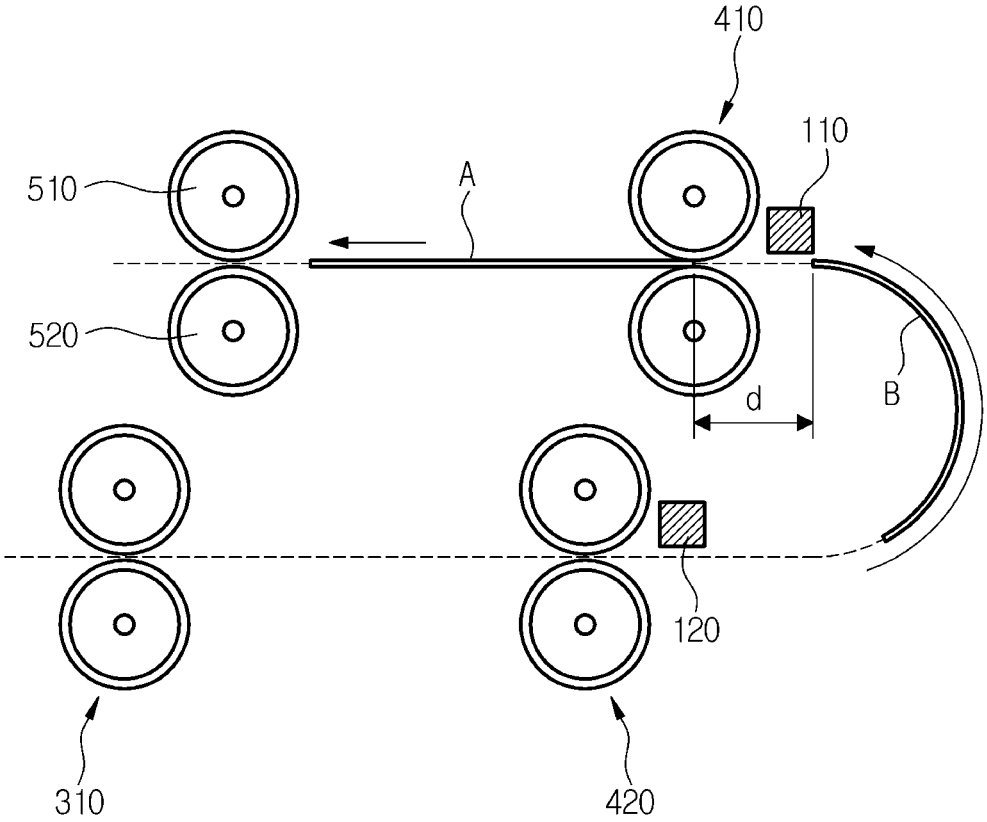

FIGS. 5A and 5B are diagrams for describing a method of controlling a paper sheet interval by a controller of an image forming apparatus according to an embodiment of the present disclosure. Dashed lines indicate a paper transport path, and arrows indicate a paper transport direction.

FIG. 5A illustrates that paper passes between the registration rollers 410 and following paper passes between the feed rollers 420.

When one leading edge of paper in a paper proceeding direction is referred to as a front edge and the other edge of the paper opposite to the front edge of the paper is referred to as a back edge, a distance between a back edge of the paper and a front edge of the following paper may be a paper sheet interval. When the paper sheet interval is greater than a predetermined interval, the controller 200 may control the transport speed of the following paper such that a predetermined paper sheet interval is maintained.

The controller 200 may acquire the transport speed of the following paper by using a change in the surface pattern of the following paper sensed by the second image sensor 120. Based thereon, the controller 200 may control the feed rollers 420 such that a transport force corresponding to the transport speed of the following paper is transferred to the following paper. In this regard, the transport force corresponding to the transport speed of the following paper may indicate a force required to accelerate the following paper such that the predetermined paper sheet interval may be maintained between the paper and the following paper.

As illustrated in FIG. 5B, when the feed rollers 420 rotate at a high speed and transfer a transport force corresponding to the transport speed of the following paper to the following paper, the following paper is transported at a high speed, thereby decreasing the paper sheet interval. As a result, the distance between the paper and the following paper may be maintained as a predetermined distance d.

Figure 6A:
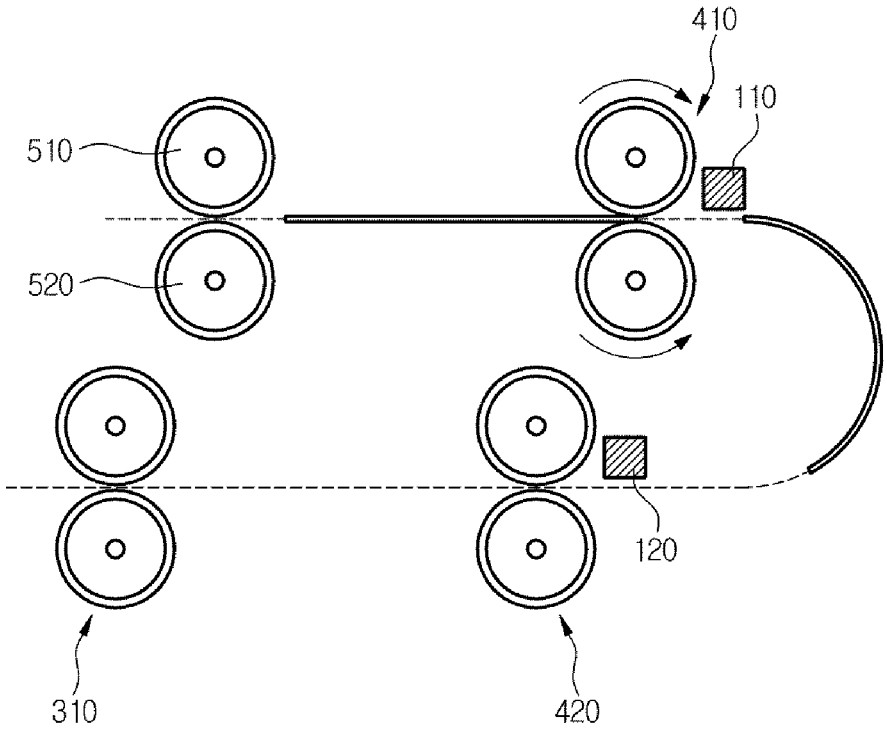
FIGS. 6A and 6B are diagrams for describing a method of controlling a paper sheet interval by a controller of an image forming apparatus according to an embodiment of the present disclosure.
Figure 6B:
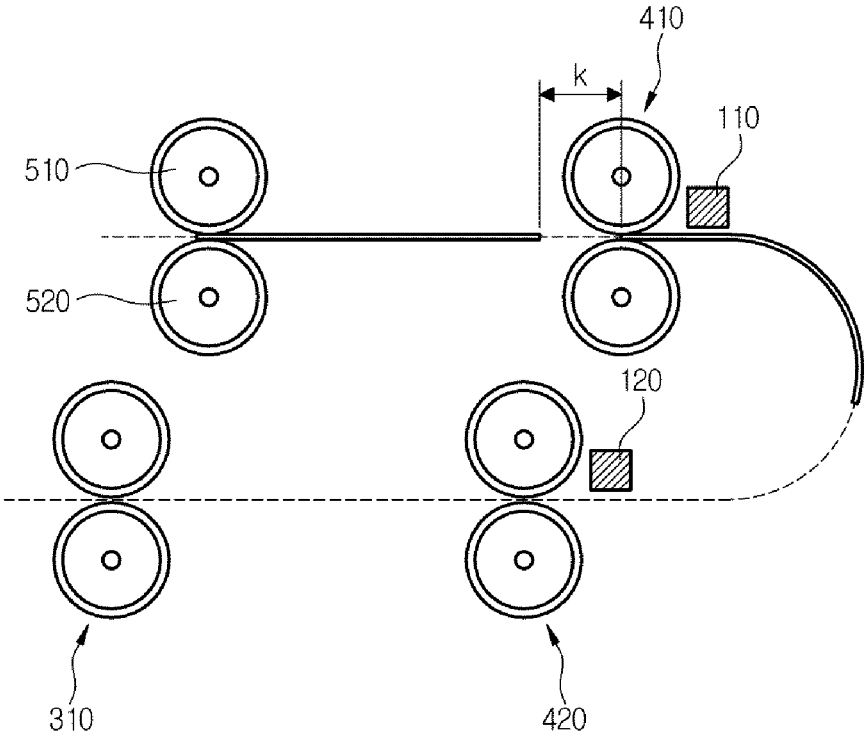

FIGS. 6A and 6B are diagrams for describing a method of controlling a paper sheet interval by a controller of an image forming apparatus according to another embodiment of the present disclosure. Dashed lines indicate a paper transport path, and arrows indicate a paper transport direction.

FIG. 6A illustrates that a paper passes between the registration rollers 410 and a following paper has already passed the feed rollers 420.

A skew of paper may occur during a printing process of the image forming apparatus. In order to correct the skew of paper, the registration rollers 410 may block proceeding of the paper. Since the feed rollers 420 transfers the transport force to the paper blocked by the registration rollers 410, the skew of paper may be corrected.

In this regard, since the paper is transported while the registration rollers 410 block the proceeding of the following paper, the paper sheet interval may increase. Thus, the controller 200 may control the registration rollers 410 such that a predetermined paper sheet interval is maintained.

The controller 200 may acquire a transport speed of the paper by using a change in the surface pattern of the paper sensed by the first image sensor 110. Based thereon, the controller 200 may control the registration rollers 410 to block the proceeding of the following paper at a time point corresponding to the transport speed of the paper. In this regard, the time point corresponding to the transport speed of the paper may indicate a time point when the paper has been discharged from the registration rollers 410 and transported by a predetermined distance.

As illustrated in FIG. 6B, the controller 200 may stop driving of the registration rollers 410 at a time point when the paper has been discharged from the registration rollers 410 and transported by a predetermined distance k. Since the registration rollers 410 are stopped during the period of time determined by the controller 200, the skew of the following paper may be corrected, and thus the distance between the paper and the following paper may be controlled.

Differently from FIGS. 6A and 6B, the controller 200 may control the paper feed unit 300 by using a transport speed of the paper. The controller 200 may control the paper feed unit 300 such that the following paper is fed at a time point corresponding to the transport speed of the paper. In this regard, the time point corresponding to the transport speed of the paper may be a time point for maintaining a predetermined paper sheet interval between the fed following paper and the paper being transported.

Alternatively, the controller 200 may control the feed rollers 420 by using the transport speed of the paper. The controller 200 may control the feed rollers 420 such that a transport force corresponding to the transport speed of the paper is transferred to the following paper. In this regard, the transport force corresponding to the transport speed of the paper may indicate a force required to accelerate the following paper such that a predetermined interval is maintained between the paper and the following paper.

The methods of controlling the paper sheet interval by using the change in the surface pattern of paper by the controller are described above. Methods of correcting a skew of paper by using a change in surface patterns of paper will be described with reference to FIGS. 7A, 7B, 8A, 8B, and 8C.

Figure 7A:
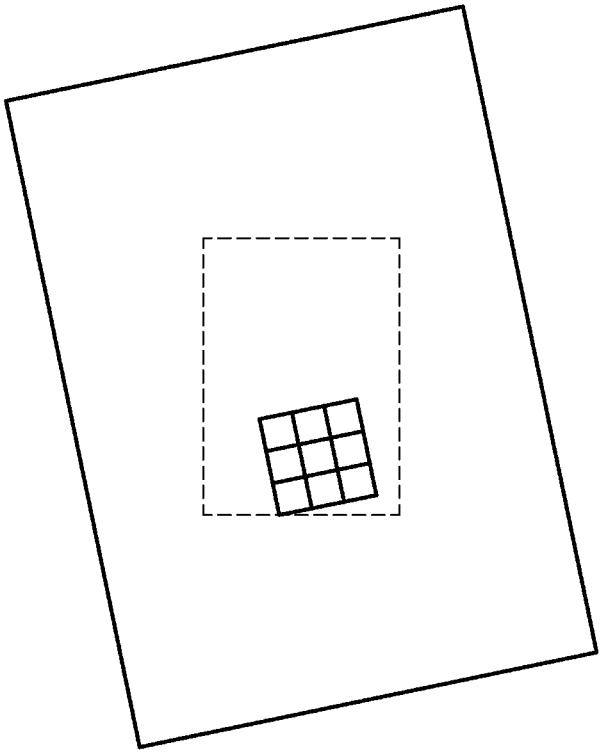
FIGS. 7A and 7B are diagrams for describing a method of acquiring the degree of skew of paper by a controller of an image forming apparatus according to an embodiment of the present disclosure.
Figure 7B:
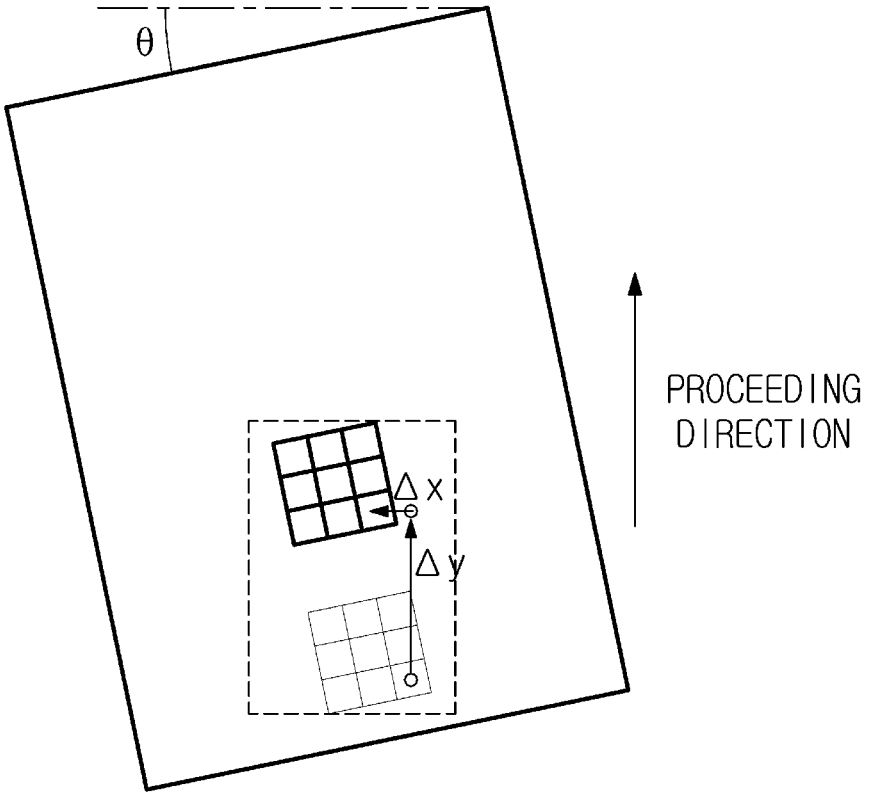

FIGS. 7A and 7B are diagrams for describing a method of acquiring the degree of skew of paper by a controller 200 of an image forming apparatus according to another embodiment of the present disclosure. Dashed lines indicate regions including surface patterns sensed by the paper sensing unit 100.

As described above, the paper sensing unit 100 may sense surface patterns of paper at regular time intervals. Since the paper sensing unit 100 may sense surface patterns of paper in real time, the controller 200 may acquire the degree of skew of paper.

For example, as illustrated in FIG. 7A, the paper sensing unit 100 may sense a surface pattern of skewed paper in a region marked by the dashed line at a desired time point. After one period T, the paper sensing unit 100 may sense the surface pattern of the paper in the region marked by the dashed line as illustrated in FIG. 7B. Referring to FIGS. 7A and 7B, it may be confirmed that the paper is transported by Δy in the proceeding direction and by Δx in a direction perpendicular to the proceeding direction.

The controller 200 may sense the degree of skew of paper by comparing the surface pattern of the paper sensed as illustrated in FIG. 7A with the surface pattern of the paper as illustrated in FIG. 7B. Particularly, the controller 200 may acquire a skew angle θ of the paper through Equation 2 and the degree of skew S of the paper by using the skew angle θ through Equation 3.

$$\sin\theta = \frac{\Delta x}{\Delta y} \qquad \text{Equation 2}$$

$$S = \frac{w}{\sin\theta} \qquad \text{Equation 3}$$

In these equations, θ is a skew angle of paper, Δy is a distance of paper moved in the paper proceeding direction, and Δx is a distance of the paper moved in the direction perpendicular to the proceeding direction of the paper. In addition, S is the degree of skew of the paper and w is a width of paper.

The controller 200 may acquire the degree of skew of paper and correct the skew of paper based thereon.

Figure 8A:
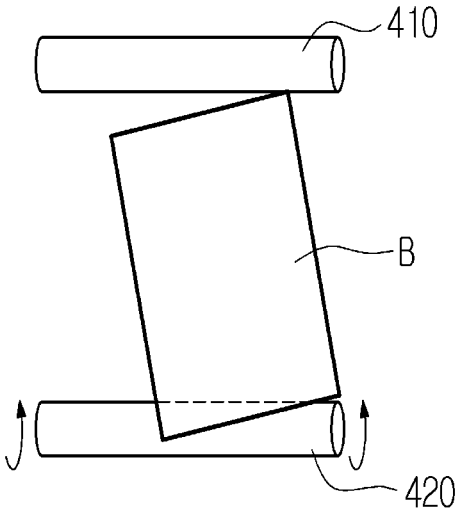
FIGS. 8A to 8C are diagrams for describing a method of controlling a skew of paper by a controller of an image forming apparatus according to an embodiment of the present disclosure.
Figure 8B:
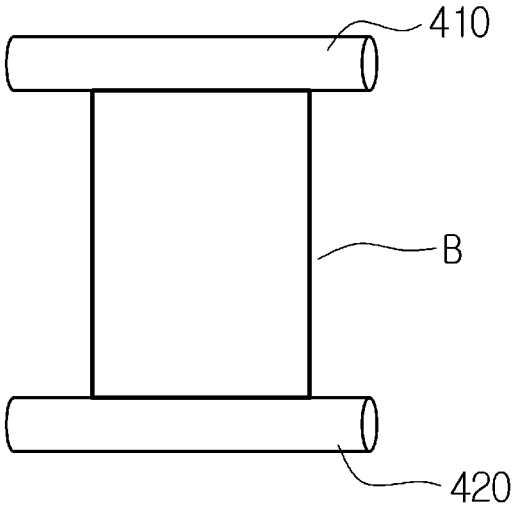
Figure 8C:
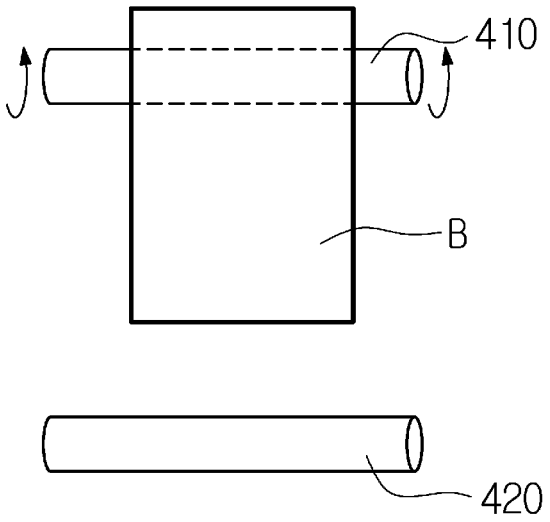

FIGS. 8A to 8C are diagrams for describing a method of controlling a skew of paper by a controller of an image forming apparatus according to the present disclosure, Arrows indicates a paper proceeding direction.

As illustrated in FIG. 8A, a skew of paper may occur during a printing process of the image forming apparatus. In this case, the controller 200 may stop driving of the registration rollers 410. Accordingly, the skew of paper to which the transport force is transferred by the feed rollers 420 may be corrected. In this case, the paper may be transported while transporting of the following paper is blocked by the registration rollers 410, and thus the paper sheet interval may increase. Thus, the controller 200 needs to stop driving of the registration rollers 410 in consideration of the degree of skew of the following paper.

The controller 200 may acquire the degree of skew of the paper when the front edge of the paper reaches the registration rollers 410. The controller 200 may correct the skew in consideration of the degree of skew when the front edge of the paper reaches the registration rollers 410.

Thus, as illustrated in FIG. 8B, the controller 200 may block the proceeding of the paper for a period of time corresponding to the degree of skew of paper. The period of time corresponding to the degree of skew of the paper may refer to a minimum period of time required for correcting the skew by blocking the proceeding of the paper by using the registration rollers 410. In accordance with the degree of skew S obtained through Equation 3, the controller 200 may stop driving of the registration rollers 410 for a period of time corresponding to the degree of skew S.

After driving of the registration rollers 410 is stopped for a period of time corresponding to the degree of skew, the paper may be transported by resuming the driving of the registration rollers 410 when the skew of the paper is completely corrected as illustrated in FIG. 8C. Thus, time required for the correction of the skew may be minimized resulting in increasing the paper sheet interval.

In addition, the controller 200 may control the image forming unit 500 to coat toner on the photosensitive drum 510 at a time point corresponding to when driving the registration rollers 410 is resumed. Since the paper is discharged from the registration rollers 410 immediately before an image is formed, the image forming unit 500 may start preparation for formation of an image on the paper at a time point corresponding to when the registration rollers 410 are resumed. Thus, the time point corresponding to when the driving of the registration rollers 410 is resumed may indicate a time point of coating toner on the photosensitive drum 510 such that an image is formed on the paper discharged from the registration roller 410, driving of which is resumed.

The controller 200 may acquire a transport speed of the paper based on a change in the surface pattern of the paper acquired by the paper sensing unit 100 and may determine a paper jam by using the same. That is, when the transport speed of the paper is equal to or less than a predetermined value or the paper is not sensed within a time corresponding to the acquired transport speed, the controller 200 may determine that a paper jam occurs in one area of the paper transport path in the image forming apparatus.

Upon determination that the paper jam occurs, the controller 200 may inform a user of the paper jam or may control the image forming apparatus to remove the paper jam in accordance with a preset paper jam-removing process.

Figure 9:
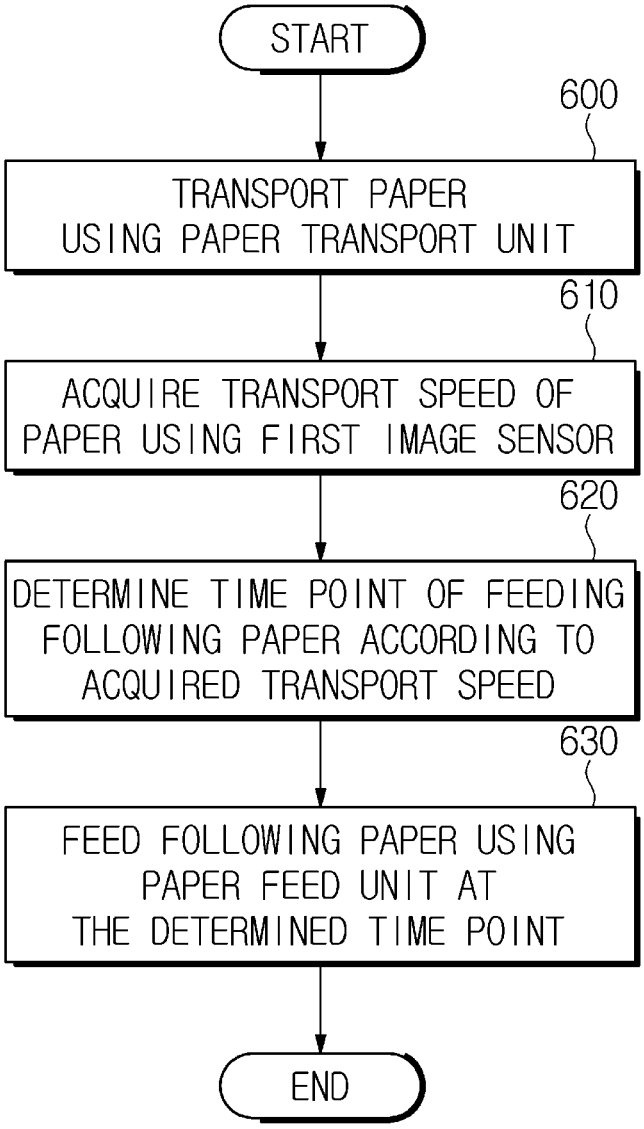
FIG. 9 is a flowchart illustrating a method of controlling a paper sheet interval according to a method of controlling an image forming apparatus according to an embodiment of the present disclosure.

FIG. 9 is a flowchart illustrating a method of controlling a paper sheet interval according to a method of controlling an image forming apparatus according to an embodiment of the present disclosure. FIG. 9 illustrates an example of a method of controlling the paper sheet interval by using a first image sensor 110.

First, paper is transported by using the paper transport unit 400 (600). The paper receives a transport force from the feed rollers 420 and is transported to the image forming unit 500 via the registration rollers 410.

A transport speed of the paper may be acquired by using a first image sensor 110 (610). Particularly, a surface pattern of the paper may be sensed by the first image sensor 110 when the paper passes between the registration rollers 410. By using a change in the sensed surface pattern of the paper, the transport speed of the paper may be acquired.

A time point of feeding following paper may be determined in accordance with the acquired transport speed of the paper (620). The time point of feeding the following paper may be determined such that a predetermined distance may be maintained between the paper being transported and the following paper.

When the time point of feeding the following paper is determined, the paper feed unit 300 may be controlled to feed the following paper at the determined time point (630). As a result, a predetermined paper sheet interval may be maintained.

Figure 10:
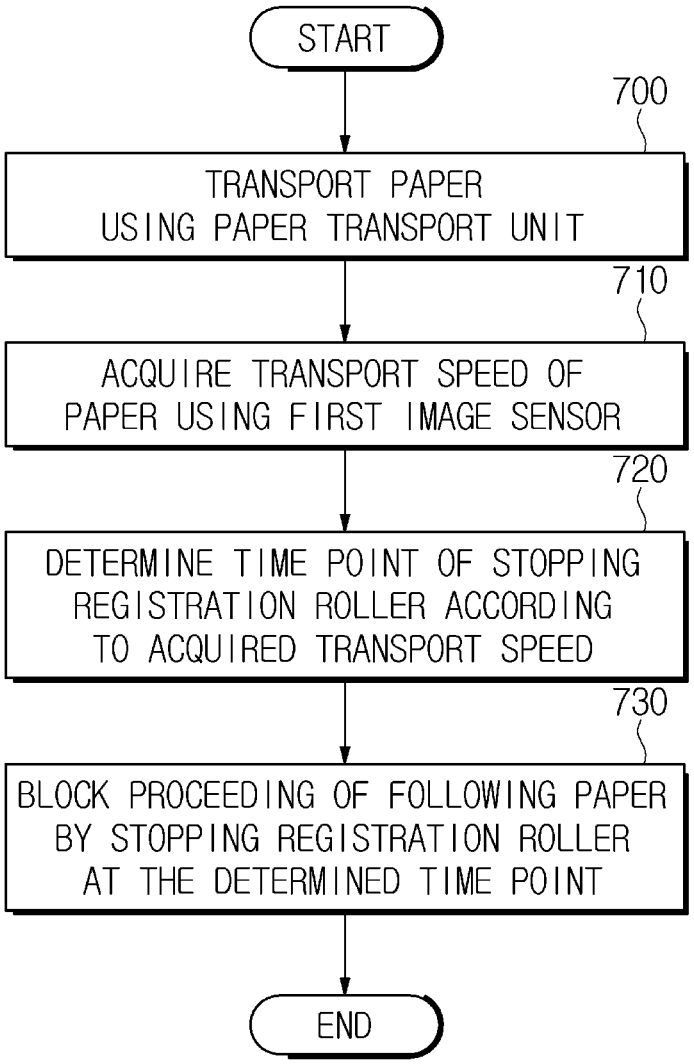
FIG. 10 is a flowchart illustrating a method of controlling a paper sheet interval according to a method of controlling an image forming apparatus according to an embodiment of the present disclosure.

FIG. 10 is a flowchart illustrating a method of controlling a paper sheet interval according to a method of controlling an image forming apparatus according to another embodiment of the present disclosure. FIG. 10 illustrates another example of the method of controlling the paper sheet interval by using the first image sensor 110.

First, paper is transported by using the paper transport unit 400 (700). The transport speed of the paper may be acquired by using the first image sensor 110 in the same manner described above with reference to FIG. 9 (710).

A time point of stopping the registration rollers 410 may be determined in accordance with the acquired transport speed of the paper (720). The time point of stopping the registration rollers 410 may be determined as a time point in which the paper has been discharged from the registration rollers 410 and transported by a predetermined distance.

When the time point of stopping is determined, the registration rollers 410 may be stopped at the determined time point (730). As the registration rollers 410 are stopped in a consideration of the transport speed of the paper, the time point of stopping the registration rollers 410 for the correction of the skew of the paper may be efficiently controlled.

Figure 11:
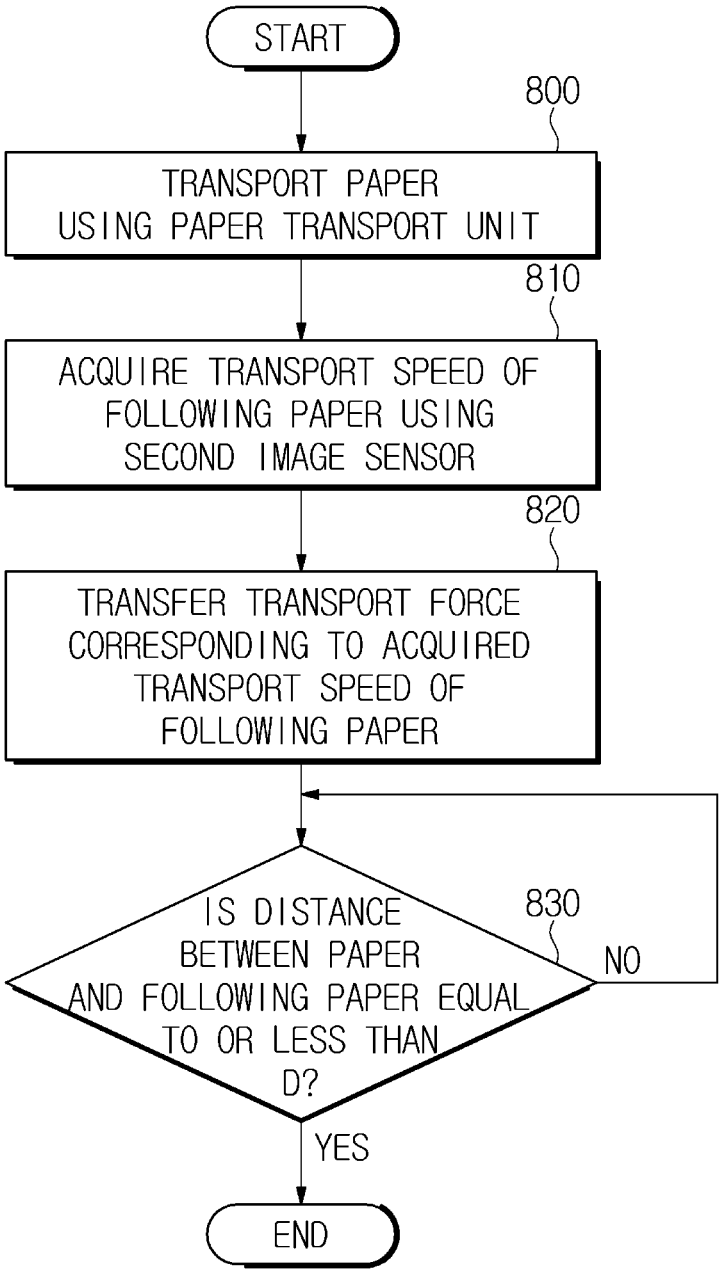
FIG. 11 is a flowchart illustrating a method of controlling a paper sheet interval according to a method of controlling an image forming apparatus according to an embodiment of the present disclosure.

FIG. 11 is a flowchart illustrating a method of controlling a paper sheet interval according to a method of controlling an image forming apparatus according to another embodiment of the present disclosure. FIG. 11 illustrates a method of controlling a paper sheet interval by using a second image sensor 120.

First, following paper may be transported by using the paper transport unit 400 (800). Particularly, the following paper may be transported by transferring a transport force to the following paper by the feed rollers 420.

While the following paper is transported, a transport speed of the following paper may be acquired by using the second image sensor 120 (810). Particularly, a surface pattern of the following paper may be sensed when the paper passes between the feed rollers 420 by the second image sensor 120. The transport speed of the following paper may be acquired based on a change in the sensed surface pattern of the following paper.

When the transport speed of the following paper is acquired, a transport force corresponding to the transport speed of the following paper may be transferred to the following paper (820). The transport force corresponding to the transport speed of the following paper may indicate a force required to accelerate the following paper such that a predetermined interval may be maintained between the paper and the following paper.

In order to determine the transport force corresponding to the transport speed of the following paper, the transport speed of the following paper, the transport speed of the paper, or the distance between the registration rollers 410 and the feed rollers 420 may be used.

As the following paper is accelerated by transferring the transport force to the following paper, it may be confirmed whether a paper sheet interval between the paper and the following paper is equal to or less than d (830). The reference letter d refers to a predetermined paper sheet interval suitable for a printing process of the image forming apparatus.

When the paper sheet interval is greater than d, the paper sheet interval may be controlled to be equal to or less than d by continuously transferring the transport force to the following paper.

On the other hand, when the paper sheet interval is equal to or less than d, the control process may be terminated since conditions for printing are satisfied.

Figure 12:
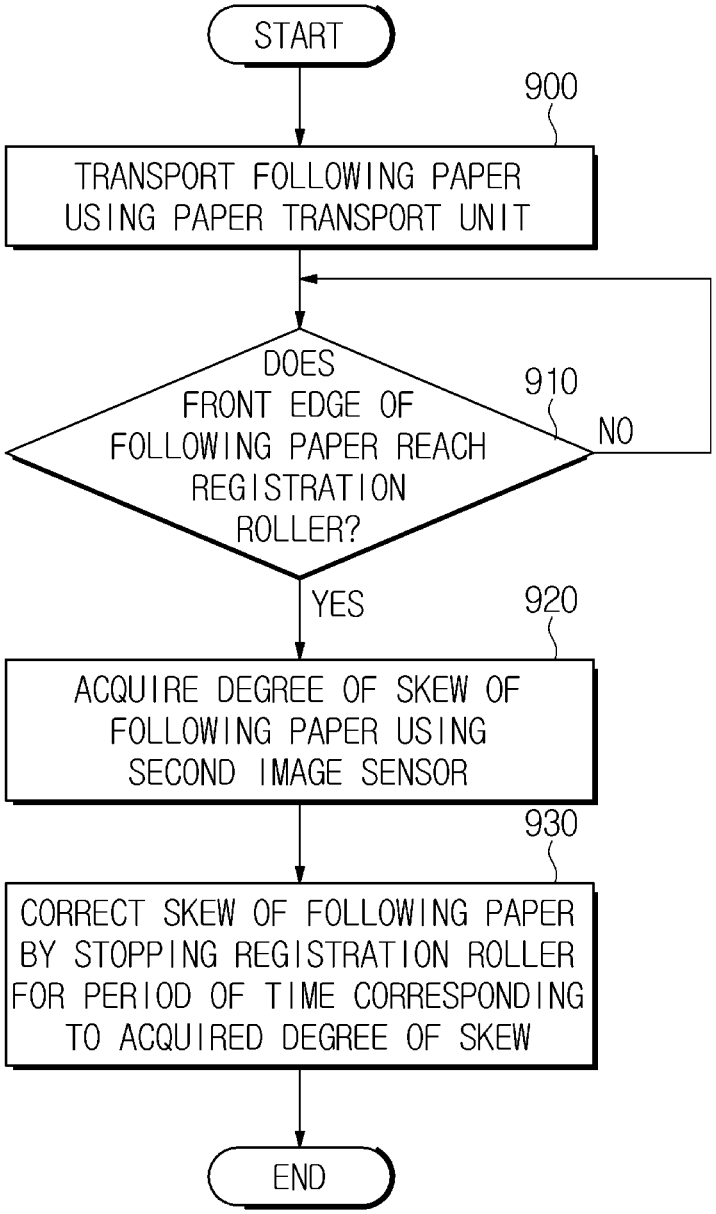
FIG. 12 is a flowchart illustrating a method of correcting a skew of paper according to a method of controlling an image forming apparatus according to an embodiment of the present disclosure.

FIG. 12 is a flowchart illustrating a method of correcting a skew of paper according to a method of controlling an image forming apparatus according to another embodiment of the present disclosure. FIG. 12 illustrates a method of correcting a skew of paper by using a second image sensor 120.

First, following paper may be transported by the paper transport unit 400 (900). The following paper may be transported by transferring a transport force to the following paper by the feed rollers 420 in the same manner described above with reference to FIG. 11.

While the following paper is transported, it may be confirmed whether the front edge of the following paper reaches the registration rollers 410 (910). The front edge of the following paper may refer to a leading edge of the following paper in the paper transport direction.

Before the front edge of the following paper reaches the registration rollers 410, it may be repeatedly confirmed whether the front edge of the following paper reaches the registration rollers 410.

On the other hand, when the front edge of the following paper reaches the registration rollers 410, the degree of skew of the following paper may be acquired by using the second image sensor 120 (920). The degree of skew of the following paper may be acquired through Equations 2 and 3 as described above.

When the degree of skew is acquired, the skew of the following paper may be corrected by stopping the registration rollers 410 for a period of time corresponding to the degree of skew (930). The period of time corresponding to the degree of skew may refer to a minimum period of time required for correcting the skew by blocking proceeding of the following paper by the registration rollers 410.

As is apparent from the above description, according to the image forming apparatus and the control method thereof according to an embodiment of the present disclosure, the distance between paper sheets may be reduced by acquiring the transport speed of paper by sensing a surface pattern of paper in real time.

According to the image forming apparatus and the control method thereof according to another embodiment of the present disclosure, the skew of paper may be efficiently removed by acquiring the degree of skew of paper by sensing a surface pattern of paper in real time.

According to the image forming apparatus and the control method thereof according to another embodiment of the present disclosure, unnecessary consumption of toner may be prevented when an image is formed in an image trans belt (IBT) by sensing a paper jam in real time.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An image forming apparatus comprising:

a paper transport unit configured to sequentially transport a plurality of sheets of paper;

a paper sensing unit disposed in a transport path of the plurality of sheets of paper and configured to sense a surface pattern of each of the transported plurality of sheets of paper; and a controller configured to acquire a first transport speed of a first sheet of paper by using the change in the surface pattern of the first sheet of paper, acquire a second transport speed of a second sheet of paper following the first sheet of paper by using the change in the surface pattern of the second sheet of paper, and control the paper transport unit to maintain a predetermined distance between the first sheet of paper and the second sheet of paper based on the first transport speed and the second transport speed.

2. The image forming apparatus according to claim 1, wherein the controller acquires a degree of skew of each of the plurality of sheets of paper by using the change in the surface pattern of each of the plurality of sheets of paper and controls the paper transport unit to correct the skew of each of the plurality of sheets of paper for a period of time based on the acquired degree of skew of each of the plurality of sheets of paper.

3. The image forming apparatus according to claim 1, wherein the paper transport unit comprises:

feed rollers configured to transfer a transport force to each of the plurality of sheets of paper; and registration rollers configured to block proceeding of each of the plurality of sheets of paper to which the transport force is transferred by the feed rollers, and the paper sensing unit is disposed in the transport path of the plurality of sheets of paper between the feed rollers and the registration rollers.

4. The image forming apparatus according to claim 3, wherein the paper sensing unit comprises a first image sensor disposed closer to the registration rollers than the feed rollers to sense the surface pattern of the first sheet of paper.

5. The image forming apparatus according to claim 4, wherein the controller acquires the first transport speed by using the change in the surface pattern of the first sheet of paper sensed by the first image sensor and controls the registration rollers to block proceeding of the second sheet of paper at a time point based on the first transport speed and the second transport speed.

6. The image forming apparatus according to claim 4, further comprising a paper feed unit configured to sequentially feed the first sheet of paper and the second sheet of paper to the paper transport unit, wherein the controller acquires the first transport speed of the first sheet of paper by using the change in the surface pattern of the first sheet of paper sensed by the first image sensor and controls the paper feed unit to feed the second sheet of paper at a time point based on the first transport speed and the second transport speed.

7. The image forming apparatus according to claim 3, wherein the paper sensing unit comprises a second image sensor disposed closer to the feed rollers than the registration rollers to sense a surface pattern of the second sheet of paper.

8. The image forming apparatus according to claim 7, wherein the controller acquires the second transport speed by using the change in the surface pattern of the second sheet of paper sensed by the second image sensor and controls the feed rollers to transfer the transport force to the second sheet so as to adjust the second transport speed.

9. The image forming apparatus according to claim 7, wherein the controller acquires the degree of skew of the second sheet of paper by using the change in the surface pattern of the second sheet of paper sensed by the second image sensor and controls the registration rollers to block proceeding of the second sheet of paper for a period of time based on the degree of skew of the second sheet of paper.

10. The image forming apparatus according to claim 9, further comprising an image forming unit configured to transfer an image to each of the plurality of sheets of paper by using a photosensitive drum on which toner is coated, wherein the controller controls the image forming unit to coat the toner on the photosensitive drum at a time point corresponding to when the registration rollers resume the proceeding of the second sheet of paper.

11. A method of controlling an image forming apparatus sequentially transporting a plurality of sheets of paper, the method comprising:

sensing a surface pattern of each of the plurality of sheets of paper;

acquiring a first transport speed of a first sheet of paper by using the change in the surface pattern of the first sheet of paper;

acquiring a second transport speed of a second sheet of paper following the first sheet of paper by using the change in the surface pattern of the second sheet of paper; and maintaining a predetermined distance between the first sheet of paper and the second sheet of paper based on the first transport speed and the second transport speed.

12. The method according to claim 11, wherein maintaining the predetermined distance comprises blocking proceeding of the second sheet of paper at a time point based on the first transport speed and the second speed.

13. The method according to claim 11, wherein the maintaining the predetermined distance comprises feeding the second sheet of paper to a paper transport unit of the image forming apparatus at a time point based on the first transport speed and the second transport speed.

14. The method according to claim 11, wherein the maintaining the predetermined distance comprises transferring a transport force to the second sheet of paper based on the first transport speed and the second transport speed.

15. The method according to claim 11, further comprising:

acquiring a degree of skew of each of the plurality of sheets of paper by using the change in the surface pattern of each of the plurality of sheets of paper: and correcting the skew of each of the plurality of sheets of paper for a period of time based on the acquired degree of skew.

16. The method according to claim 15, wherein the acquiring of the degree of each of skew of the plurality of sheets of paper comprises acquiring the degree of skew of each of the plurality of sheets of paper when a front edge of each of the plurality of sheets of paper reaches registration rollers of the image forming apparatus.

17. The method according to claim 15, wherein the correcting of the skew of each of the plurality of sheets of paper comprises blocking proceeding of each of the plurality of sheets of paper for a period of time based on the degree of skew of each of the plurality of sheets of paper.

18. The method according to claim 17, further comprising coating toner on a photosensitive drum of the image forming apparatus based on a time point when the blocked proceeding of each of the plurality of sheets of paper is resumed.

* * * * *